US009682575B2

(12) United States Patent
Sasaki et al.

(10) Patent No.: US 9,682,575 B2
(45) Date of Patent: Jun. 20, 2017

(54) LIQUID DISCHARGING APPARATUS

(71) Applicant: SEIKO EPSON CORPORATION, Tokyo (JP)

(72) Inventors: Tsuneyuki Sasaki, Matsumoto (JP); Eiji Kumai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/111,318

(22) PCT Filed: Jan. 19, 2015

(86) PCT No.: PCT/JP2015/000197
§ 371 (c)(1),
(2) Date: Jul. 13, 2016

(87) PCT Pub. No.: WO2015/115047
PCT Pub. Date: Aug. 6, 2015

(65) Prior Publication Data

US 2016/0325561 A1 Nov. 10, 2016

(30) Foreign Application Priority Data

Jan. 30, 2014 (JP) ..... 2014-015913

(51) Int. Cl.
*B41J 11/00* (2006.01)
*B41J 15/16* (2006.01)
*B41J 15/00* (2006.01)

(52) U.S. Cl.
CPC ..... *B41J 11/002* (2013.01); *B41J 15/16* (2013.01); *B41J 15/165* (2013.01); *B41J 11/0005* (2013.01); *B41J 15/00* (2013.01)

(58) Field of Classification Search
CPC . B41J 11/002; B41J 15/16; B41J 11/00; B41J 11/0005; B41J 15/00; B41J 15/165
USPC ..... 347/104
See application file for complete search history.

(56) References Cited

U.S. PATENT DOCUMENTS 5,712,672 A * 1/1998 Gooray ..... B41J 2/01 219/691
2002/0062750 A1* 5/2002 Wotton ..... B41J 11/002 101/232
2002/0067401 A1* 6/2002 Yraceburu ..... B41J 11/002 347/102

FOREIGN PATENT DOCUMENTS

JP 10-217572 A 8/1998
JP 2000-075773 A 3/2000
JP 2009-134207 A 6/2009
JP 2009-249060 A 10/2009

OTHER PUBLICATIONS

ISR and Written Opinion dated Mar. 27, 2015 for PCT/JP2015/000197.

* cited by examiner

*Primary Examiner* — Alexander D Shenderov
(74) *Attorney, Agent, or Firm* — Workman Nydegger

(57) ABSTRACT

Provided is a liquid discharging apparatus that includes a medium support portion which supports a recording medium and a tension applying portion which applies tension to the medium support portion.

7 Claims, 12 Drawing Sheets

LIQUID DISCHARGING APPARATUS

TECHNICAL FIELD

The present invention relates to a liquid discharging apparatus.

BACKGROUND ART

Hitherto, a liquid discharging apparatus including a medium support portion which supports a recording medium has been used.

An ink jet recording apparatus in which a mesh member is provided as a medium support portion, a heater as a drying device is disposed in the vicinity of the mesh member, and steam can be removed to the outside through the mesh member has been disclosed in, for example, PTL 1.

A recording apparatus in which a heating roller as a drying device comes into contact with a toner image transferred onto a transfer material which is supported by a sling as a medium support portion and functions as a recording medium, in such a manner that moisture contained in the transfer material evaporates into steam and the steam passes through the sling has been disclosed in, for example, PTL 2.

CITATION LIST

Patent Literature

PTL 1: JP-A-10-217572
PTL 2: JP-A-2000-75773

SUMMARY OF INVENTION

Technical Problem

However, in the recording apparatus of the related art, a medium support portion which supports a recording medium is deformed in some cases. Particularly, in the case of the medium support portion disclosed in PTL 1, which is constituted of the mesh member and has the heater disposed in the vicinity thereof, the mesh member is thermally deformed in some cases. Furthermore, when the heating roller comes into contact with the transfer material which is supported by the sling as a medium support portion and functions as a recording medium, as in the case of the recording apparatus disclosed in PTL 2, the sling as a medium support portion is deformed, in some cases, by a pressing force of the heating roller or a thermal influence.

When a medium support portion is deformed, a recording medium supported by the medium support portion is deformed. As a result, in some cases, a failure in image quality, a failure in medium transport, or the like can occur.

Accordingly, an object of the invention is to suppress or control deformation of a medium support portion which supports a recording medium and reduce a possibility that the recording medium supported by the medium support portion may be deformed.

Solution to Problem

According to a first aspect of the invention for solving the problem described above, there is provided a liquid discharging apparatus which includes a medium support portion which supports a recording medium, and a tension applying portion which applies tension to the medium support portion.

According to the aspect, the tension applying portion is provided to apply tension to the medium support portion. As a result, the medium support portion is stretched, and thus the medium support portion can be prevented from being deformed.

According to a second aspect of the invention, the tension applying portion of the first aspect includes an elastic member.

According to the aspect, the tension applying portion includes the elastic member. As a result, the medium support portion is pulled by the elastic member, in such a manner that the tension applying portion can be simply provided at a low cost.

According to a third aspect of the invention, the elastic member of the second aspect is connected to the medium support portion and a member less likely to be deformed than the medium support portion.

According to the aspect, the elastic member is connected to the medium support portion and the member less likely to be deformed than the medium support portion. In other words, the medium support portion is connected, through the elastic member, to the member less likely to be deformed than the medium support portion. As a result, the medium support portion can be effectively prevented from being deformed.

According to a fourth aspect of the invention, the liquid discharging apparatus of any one of the first to third aspects, further includes a liquid discharging portion which discharges liquid onto the recording medium, and a drying device which heats and dries the liquid, in which, when the drying device dries the liquid, the medium support portion supports the recording medium.

In the case of a liquid discharging apparatus having a configuration in which, when a drying device dries liquid, a recording medium is supported by a medium support portion, particularly, the medium support portion is likely to be deformed. The reason for this is that the medium support portion is likely to be thermally deformed by the influence of the drying device. However, according to the aspect, even in such a liquid discharging apparatus, the medium support portion can be prevented from being deformed because the tension applying portion is provided to apply tension to the medium support portion.

According to a fifth aspect of the invention, the medium support portion of the fourth aspect has an opening portion which allows steam generated at the time of drying the liquid using the drying device to pass therethrough.

According to the aspect, the opening portion is provided in the medium support portion to allow steam, which is generated at the time of drying the liquid using the drying device, to pass therethrough. As a result, the steam can be removed, through the opening portion, from the vicinity of the medium support portion, and thus the steam can be prevented from condensing in the medium support portion.

According to a sixth aspect of the invention, the liquid discharging apparatus of the fifth aspect further includes a dew-condensation inducing portion which condenses the steam passing through the opening portion.

According to the aspect, the dew-condensation inducing portion is provided to condense the steam passing through the opening portion. Accordingly, the steam is removed, through the opening portion, from the vicinity of the medium support portion and, further, the dew-condensation inducing portion condenses the steam, in such a manner that the concentration of the steam can be reduced. As a result, the steam can be effectively prevented from condensing in the medium support portion.

According to a seventh aspect of the invention, the medium support portion of the fifth or sixth aspect has a mesh member.

According to the aspect, the medium support portion has the mesh member. Accordingly, the opening portion can be simply provided at a low cost. Furthermore, the steam is removed, through the opening portion, from the vicinity of the medium support portion and, further, the dew-condensation inducing portion condenses the steam, in such a manner that the concentration of the steam can be reduced. As a result, the steam can be effectively prevented from condensing in the medium support portion.

DESCRIPTION OF EMBODIMENT

The details of a recording apparatus as a liquid discharging apparatus according to an embodiment of the invention will be described with reference to the accompanying drawings.

The overview of a recording apparatus 1 according to the embodiment of the invention will be described. The recording apparatus 1 is a recording apparatus which can record, using water-based ink, an image (such as a photo, a letter, a mark, and an illustration) onto a recording medium P. However the recording apparatus 1 is not limited to a recording apparatus in which water-based ink is used.

Figure 1:
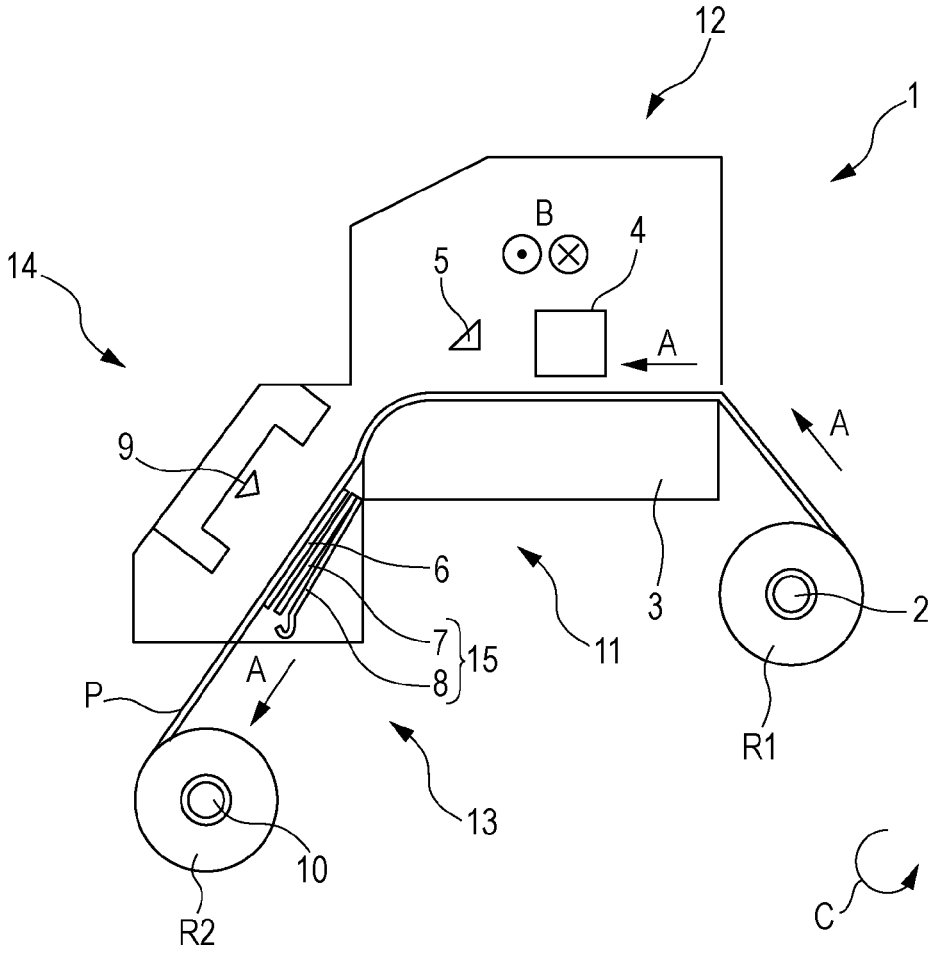
FIG. 1 is a schematic side view illustrating a recording apparatus of an embodiment of the invention.

FIG. 1 illustrates a schematic side view of the recording apparatus 1 of this embodiment.

The recording apparatus 1 of this embodiment includes a setting portion 2 of the recording medium P. The setting portion 2 can feed a roll R1 of the recording medium P onto which recording is performed. The recording apparatus 1 of this embodiment uses, as the recording medium P, a roll type recording medium. However, the recording apparatus 1 is not limited to a recording apparatus in which such a roll-type recording medium is used. A single-sheet (cut-sheet) type recording medium, for example, may be used in the recording apparatus.

When the recording medium P is transported in the transporting direction A, the recording apparatus 1 of this embodiment causes the setting portion 2 to be driven such that the setting portion 2 rotates in a rotating direction C. At this time, the roll R1 mounted on the setting portion 2 also rotates, in accordance with rotation of the setting portion 2. When the roll R1 rotates, the recording medium P is separated from the roll R1 and transported in the transporting direction A.

In the recording apparatus 1 of this embodiment, a transport mechanism 11 is provided in the platen 3. The transport mechanism 11 includes a plurality of transport rollers (not illustrated) for transporting the roll type recording medium P in the transporting direction A. When the recording medium P is transported in the transporting direction A, the setting portion 2 may not be rotationally driven. The setting portion 2 may have a configuration as follows. The setting portion 2 is configured to be rotationally driven so that the setting portion 2 is rotationally driven by driving the transport mechanism 11.

The recording apparatus 1 of this embodiment includes a recording mechanism 12 which causes a recording head 4 as a liquid discharging portion to reciprocate in an intersecting direction B intersecting the transporting direction A of the recording medium P, in such a manner that the recording mechanism 12 performs recording. The recording head 4 discharges ink onto the recording medium P. An image is formed (recorded) onto the recording medium P by the ink discharged from the recording head 4.

The recording apparatus 1 of this embodiment includes the recording head 4 which reciprocates and performs recording. However, the recording apparatus 1 may be a recording apparatus having a so-called line head in which a plurality of nozzles through which ink is discharged are arranged in the intersecting direction B intersecting the transporting direction A.

In this case, the "line head" means a recording head of which a nozzle area in the intersecting direction B intersecting the transporting direction A of the recording medium P can cover the entirety of the recording medium P in the intersecting direction B, in which either one of the recording head or the recording medium P is fixed and the other is moved, in such a manner that an image is formed. In the line head, the nozzle area in the intersecting direction B may not cover, in the intersecting direction B, the entirety of a recording medium P of all types used in the recording apparatus.

In the recording mechanism 12, an infrared heater 5 is provided to dry the ink discharged from the recording head 4.

The wavelength of an infrared ray from the infrared heater 5 is in the range of 0.76 micrometers to 1000 micrometers.

Generally, infrared rays are specifically classified into near infrared rays, middle infrared rays, and far infrared rays, in accordance with the wavelength thereof. Although there are various definitions of the classification, the wavelengths of infrared rays are as follows. The wavelength of a near infrared ray is in the range of approximately 0.78 micrometers to 2.5 micrometers. The wavelength of a middle infrared ray is in the range of approximately 2.5 micrometers to 4.0 micrometers. The wavelength of a far infrared ray is in the range of approximately 4.0 micrometers to 1000 micrometers. Among the near infrared rays, middle infrared rays, and far infrared rays, the middle infrared rays are preferably used.

Furthermore, in the recording apparatus 1 of this embodiment, a medium support mechanism 13 is provided in the area downstream from the recording head 4 in the transporting direction A of the recording medium P. The medium support mechanism 13 has a medium support portion 6 and a dew-condensation inducing portion 15 which has a first dew-condensation inducing portion 7 and a second dew-condensation inducing portion 8. The details of the medium support mechanism 13 will be described below.

In the recording apparatus 1 of this embodiment, a dry mechanism 14 is provided at a position facing the medium support portion 6. The dry mechanism 14 heats and dries both the recording medium P transported to the medium support portion 6 and the ink discharged onto the recording medium P. The dry mechanism 14 has an infrared heater 9 as a drying device. In the recording apparatus 1 of this embodiment, a radiant heat transmission type drying device using the infrared heater 9 is applied as a drying device. However, the type, the shape, the installation position, or the like of a drying device is not particularly limited as long as it can dry ink recorded onto the recording medium P by the recording head 4. For example, a convective heat transmission type drying device which transfers heat by blowing an air flow, such as hot air, to the recording medium P and evaporates liquid may be applied as a drying device. An internal heat generation type drying device which emits microwaves to the recording medium P and heats the recording medium P from inside may be applied as a drying device. Furthermore, both types may be used in combination.

A winding portion 10 is provided in the area downstream from the dry mechanism 14 in the transporting direction A of the recording medium P. The winding portion 10 can wind the recording medium P into the shape of a roll R2. When the recording medium P is wound, the winding portion 10 of the recording apparatus 1 of this embodiment rotates in the rotating direction C.

Next, the details of the medium support mechanism 13 will be described.

Figure 2:
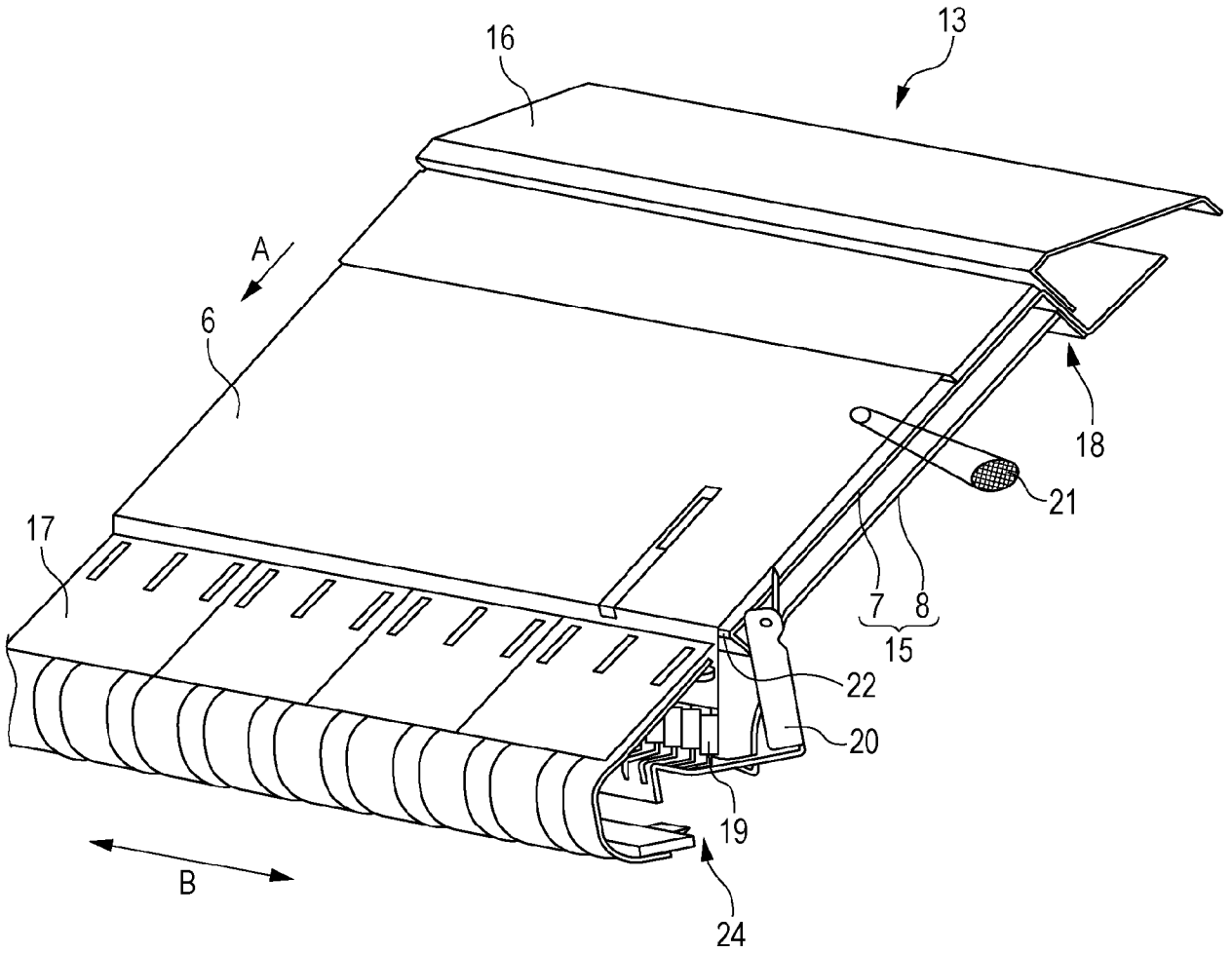
FIG. 2 is a schematic perspective view of a medium support mechanism in the recording apparatus of the embodiment of the invention, when viewed from a medium support portion side.
Figure 3:
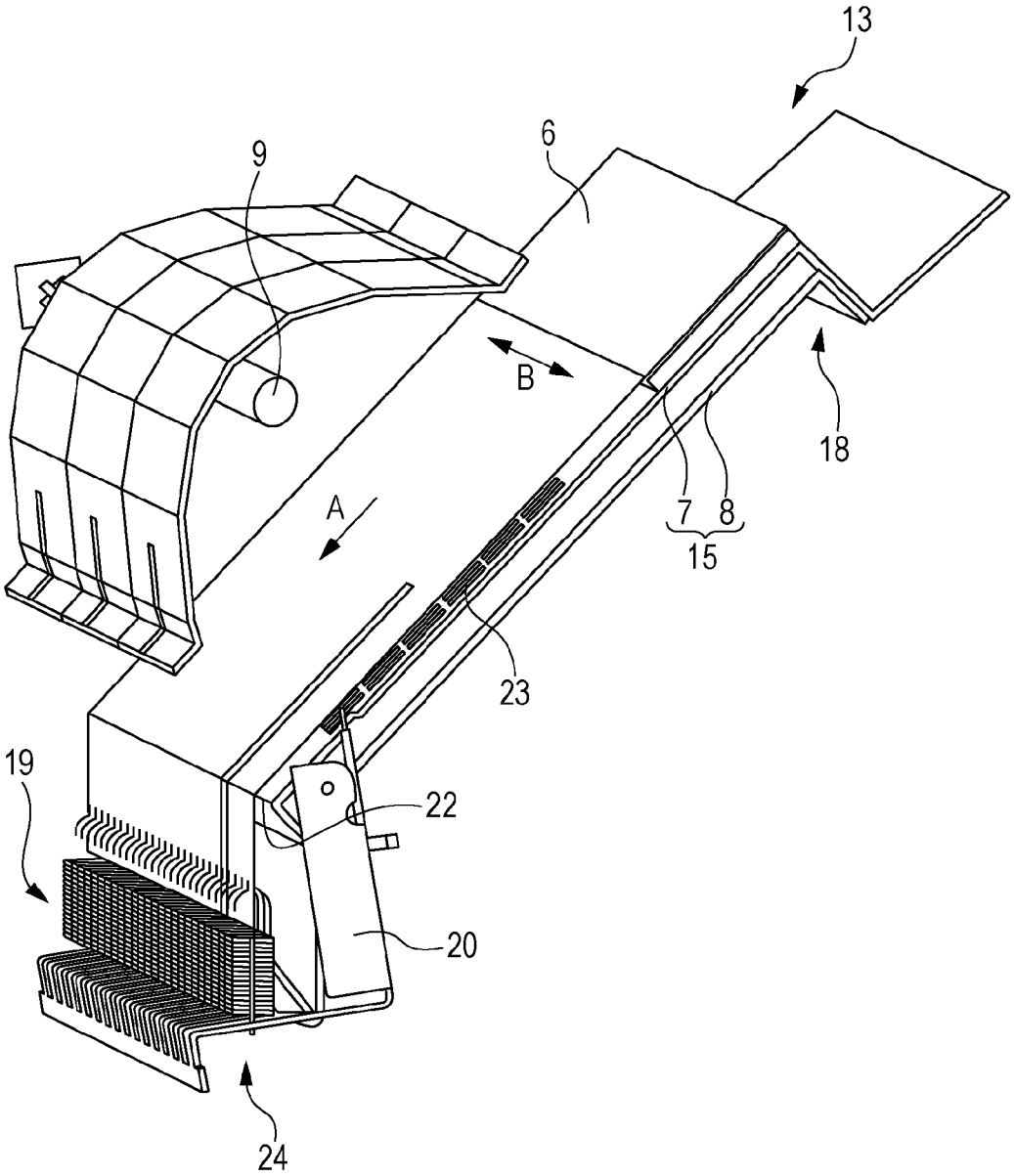
FIG. 3 is a schematic perspective view of the medium support mechanism in the recording apparatus of the embodiment of the invention, when viewed from the medium support portion side.
Figure 4:
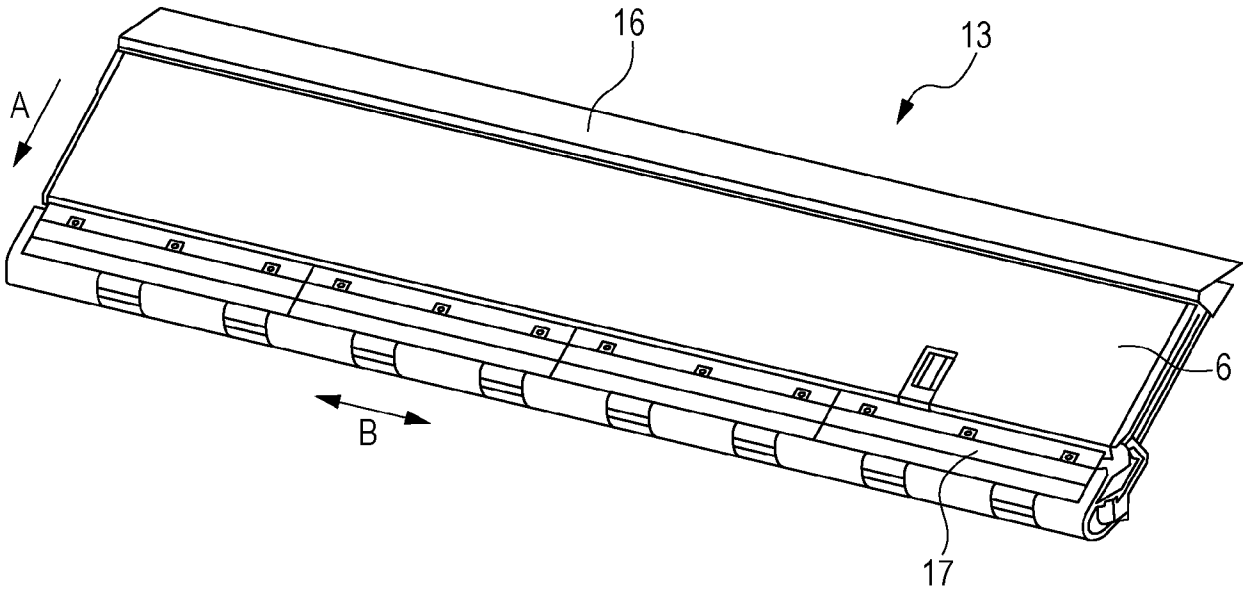
FIG. 4 is a schematic perspective view illustrating the medium support portion in the recording apparatus of the embodiment of the invention.
Figure 5:
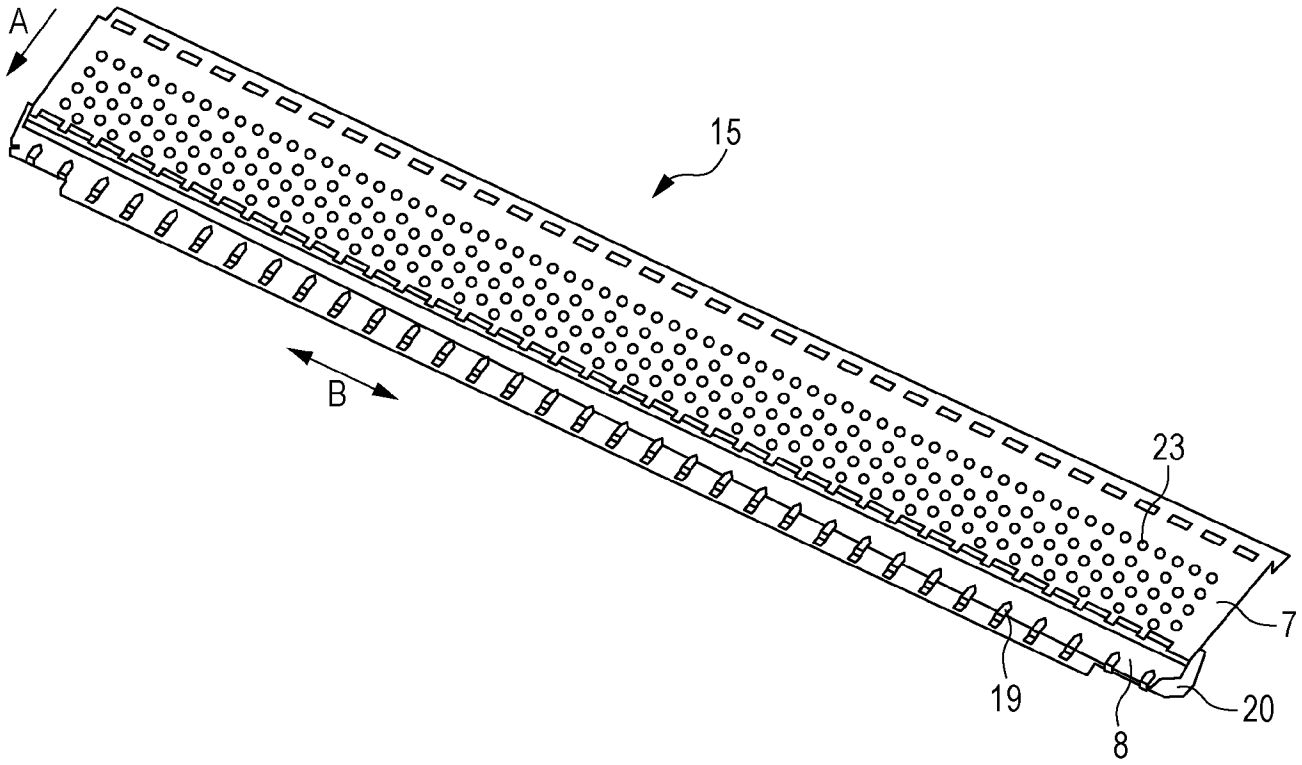
FIG. 5 is a schematic perspective view illustrating a dew-condensation inducing portion in the recording apparatus of the embodiment of the invention.

FIGS. 2 and 3 are schematic perspective views of the medium support mechanism 13 in the recording apparatus 1 of the embodiment of the invention, when viewed from (obliquely above) the medium support portion 6 side. FIG. 4 is a schematic perspective view illustrating the medium support portion 6 of this embodiment and FIG. 5 is a schematic perspective view illustrating the dew-condensation inducing portion 15 of this embodiment.

The medium support mechanism 13 of this embodiment includes the medium support portion 6, a fixing member 16, and a fixing member 17, as illustrated in FIGS. 2 and 4. The medium support portion 6 is disposed at a position facing the infrared heater 9 of the dry mechanism 14 and supports the recording medium P. The fixing member 16 is disposed in the area upstream from the medium support portion 6 in the transporting direction A and fixed to the medium support portion 6. The fixing member 17 is disposed in the area downstream from the medium support portion 6 in the transporting direction A and fixed to the medium support portion 6. Both the fixing member 16 and the fixing member 17 can support the recording medium P, similarly to the medium support portion 6. FIG. 3 illustrates a state in which both the fixing member 16 and the fixing member 17 are removed.

Opening portions 21 are provided in the medium support portion 6, as shown in the enlarged illustration of the medium support portion 6 in FIG. 2. Steam which is generated at the time of drying ink using the infrared heater 9 passes through the opening portions 21. The opening portions 21 are provided over at least a part of the medium support portion 6, which can come into contact with the recording medium P. It is preferable that at least a part of the medium support portion 6 be constituted of a linear member. Furthermore, it is preferable that a part of the medium support portion 6 have a mesh shape (a reticular shape) constituted by the linear member. The reason for this is that a mesh shape is suitable for supporting a medium and allowing steam to pass therethrough. An example of a linear member includes a thin-linear-shaped metallic member, such as a steel wire. Furthermore, a linear member may be constituted of a material other than a steel wire. In this case, meshes of a net in the medium support portion 6 correspond to the opening portions 21. The shape or the like of the opening portion 21 is not particularly limited. However, it is preferable that at least a part of the opening portion 21 be constituted of a linear member of which the diameter is set in the range of 0.05 mm to 0.3 mm. Furthermore, it is preferable that the opening area ratio of the opening portion 21, relating to the medium support portion 6, be set in the range of equal to or greater than 40% and less than 100%.

The medium support mechanism 13 includes the dew-condensation inducing portion 15 which condenses steam passing through the opening portions 21. The dew-condensation inducing portion 15 includes the first dew-condensation inducing portion 7 and the second dew-condensation inducing portion 8 which condense steam passing through the opening portions 21 of the medium support portion 6. In the first dew-condensation inducing portion 7, opening portions 23 are provided to allow steam to pass therethrough, as illustrated in FIGS. 3 and 5. The second dew-condensation inducing portion 8 includes a plate-shaped member which does not have opening portions for allowing steam to pass therethrough. The second dew-condensation inducing portion 8 has a configuration in which steam passing through the opening portions 23 of the first dew-condensation inducing portion 7 can be condensed in the plate-shaped member.

In a fastening portion 18 on the upstream side in the transporting direction A, the medium support portion 6, the first dew-condensation inducing portion 7, and the second dew-condensation inducing portion 8 are fastened to one another and are connected to a case body of the recording apparatus 1, as illustrated in FIGS. 2 and 3. Accordingly, on the upstream side of the medium support portion 6 in the transporting direction A, heat from the infrared heater 9 is easily transferred from the medium support portion 6 to the first dew-condensation inducing portion 7, the second dew-condensation inducing portion 8, and the case body of the recording apparatus 1. Thus, it is difficult for the upstream side of the medium support portion 6 in the transporting direction A to become a high temperature. Accordingly, it is difficult for the upstream side of the medium support portion 6 in the transporting direction A to be thermally expanded due to heat. However, the configuration is not limited to the configuration described above. The medium support portion 6, the first dew-condensation inducing portion 7, and the second dew-condensation inducing portion 8 may not be in contact with one another, on the upstream side in the transporting direction A.

In contrast, the medium support portion 6, the first dew-condensation inducing portion 7, and the second dew-condensation inducing portion 8 are not fastened to one another, on the downstream side in the transporting direction A. Accordingly, it is easy for the downstream side of the medium support portion 6 in the transporting direction A to become a high temperature. Thus, it is easy for the downstream side of the medium support portion 6 in the transporting direction A to be thermally expanded. However, In the recording apparatus 1 of this embodiment, a plurality of springs 19 as a tension applying portion for applying tension to the medium support portion 6 are aligned in the intersecting direction B intersecting the transporting direction A, in a tension applying mechanism 24 which is located on the downstream side of the medium support portion 6 in the transporting direction A, as illustrated in FIGS. 2 and 3. The medium support portion 6 is stretched by the springs 19. Accordingly, even when the medium support portion 6 is thermally expanded, the springs 19 can absorb deformation of the medium support portion 6, resulting from the expansion. As a result, it is possible to reduce the possibility that the recording medium P supported by the medium support portion 6 may be deformed.

In the recording apparatus 1 of this embodiment, the spring 19 is used as a tension applying portion. However, the configuration of the recording apparatus 1 is not limited thereto. However, it is preferable that an elastic member, such as the spring 19, be used as a tension applying portion. The reason for this is as follows. The medium support portion 6 is pulled by an elastic member, in such a manner that a tension applying portion can be provided at a low cost.

Furthermore, in the recording apparatus 1 of this embodiment, a reinforcing member 20 is provided on the downstream side of the second dew-condensation inducing portion 8 in the transporting direction A. The reinforcing member 20 is a member less likely to be deformed than the medium support portion 6. The springs 19 are connected to both the medium support portion 6 and the reinforcing member 20. The medium support portion 6 is connected, via the springs 19, to a member less likely to be deformed than the medium support portion 6, as described above. As a result, in the recording apparatus 1 of this embodiment, it is possible to effectively prevent the medium support portion 6 from being deformed.

Furthermore, the recording apparatus 1 of this embodiment includes the recording head 4 which discharges ink onto the recording medium P and the infrared heater 9 which heats and dries ink, as described above. In addition, the medium support portion 6 is disposed at a position facing the infrared heater 9. Accordingly, it is possible to say that, when the infrared heater 9 dries ink, the medium support portion 6 supports the recording medium P.

In the case of a recording apparatus having such a configuration in which, when a drying device dries ink, a medium support portion supports a recording medium P, particularly, the medium support portion is likely to be deformed by heat. However, although the recording apparatus 1 of this embodiment is a recording apparatus of the type described above, the springs 19 are provided to apply tension to the medium support portion 6, and thus deformation of the medium support portion 6 is absorbed by an elastic force of the spring. As a result, the medium support portion is prevented from being deformed.

In the recording apparatus 1 of this embodiment, both the medium support portion 6 and the dew-condensation inducing portion 15 are provided at a position facing the infrared heater 9 which is disposed on the area downstream from the recording mechanism 12 in the transporting direction A and functions as an after-heater. However, both the medium support portion 6 and the dew-condensation inducing portion 15 of this embodiment may be disposed at a position (which is the position of the platen 3) facing the infrared heater 5 which is disposed in the recording mechanism 12 and functions as a printer heater.

The medium support portion 6 of this embodiment is constituted of a mesh member, as shown in the enlarged illustration of the medium support portion 6 in FIG. 2. The opening portions 21 through which steam generated at the time of drying the ink using the infrared heater 9 passes are provided in the medium support portion 6. Accordingly, the steam can be removed, through the opening portions 21, from the vicinity of the medium support portion 6. As a result, the steam can be prevented from condensing in the medium support portion 6.

The recording apparatus 1 of this embodiment includes the dew-condensation inducing portion 15 which condenses the steam passing through the opening portion 21, as described above. Accordingly, the steam is removed, through the opening portions 21, from the vicinity of the medium support portion 6 and, further, the dew-condensation inducing portion 15 condenses the steam, in such a manner that the concentration of the steam can be reduced. As a result, the steam can be effectively prevented from condensing in the medium support portion 6.

Although the shape or the like of the opening portion 21 is not particularly limited, it is preferable that at least a part of the opening portion 21 be constituted of a linear member having a diameter equal to or less than 0.3 mm. The reason for this is that steam can be prevented, with high reliability, from condensing in the contact portion between the medium support portion 6 and the recording medium P.

It is preferable that the opening area ratio of the opening portion 21, relating to the medium support portion 6, be equal to or greater than 40%. The reason for this is that steam can be prevented, with high reliability, from condensing in the medium support portion 6.

The medium support portion 6 of this embodiment is constituted of a mesh member, as described above. Accordingly, the opening portions 21 are simply provided in the medium support portion 6 of this embodiment, at a low cost. Furthermore, the steam is removed, through the opening portions 21, from the vicinity of the medium support portion 6 and, further, the dew-condensation inducing portion 15 condenses the steam, in such a manner that the concentration of the steam can be reduced. As a result, the steam can be effectively prevented from condensing in the medium support portion 6.

To prevent the steam from condensing in the medium support portion 6, the medium support portion 6 of the recording apparatus 1 of this embodiment is formed of stainless steel (SUS) and the dew-condensation inducing portion 15 (which is constituted of the first dew-condensation inducing portion 7 and the second dew-condensation inducing portion 8) is formed of aluminum having a thermal conductivity higher than that of SUS. The dew-condensation inducing portion 15 has a thermal conductivity higher than that of the medium support portion 6, in such a manner that the steam is induced to condense in the dew-condensation inducing portion 15. As a result, the steam is prevented from condensing in the medium support portion 6. However, the configuration is not limited thereto.

In the recording apparatus 1 of this embodiment, the reinforcing member 20 is constituted of an electrolytic zinc-coated steel sheet (SECC). However, without being limited thereto, the reinforcing member 20 may have a shape less likely to be deformed than the medium support portion 6 and be constituted of, for example, SUS.

Similar to the medium support portion 6 of this embodiment, it is preferable that at least a part of a medium support portion be formed of stainless steel. Stainless steel is sturdy and not expensive. Furthermore, the temperature conductivity and the thermal conductivity of stainless steel are low. Accordingly, the contact angle between a stainless steel sheet and a liquid droplet as a result of condensing of steam is great, and thus a stainless steel sheet is less likely to wet. As a result, steam can be prevented, with high reliability, from condensing in the medium support portion 6.

A member which is formed of a metal (for example, steel or iron) other than stainless steel and subjected to nickel plating or chrome plating may be used as the medium support portion 6. Such a member also has a low temperature conductivity and a low thermal conductivity. Accordingly, the contact angle between the member and a liquid droplet as a result of condensing of steam is great, and thus the member is less likely to wet. As a result, steam can be prevented, with high reliability, from condensing in the medium support portion 6.

The reinforcing member 20 is a member less likely to be deformed than the medium support portion 6, in terms of physics and thermodynamics. In other words, the reinforcing member 20 is also a low thermal expansion portion of which the thermal expansion coefficient is smaller than that of the dew-condensation inducing portion 15.

Thus, it is possible to say that the recording apparatus 1 of this embodiment includes the reinforcing member 20 which is connected to the dew-condensation inducing portion 15 and has the thermal expansion coefficient smaller than that of the dew-condensation inducing portion 15.

In the recording apparatus 1 of this embodiment, the medium support portion 6 is in contact with a ridge of an end portion 22 of the first dew-condensation inducing portion 7, in which the end portion 22 is located on the downstream side of the first dew-condensation inducing portion 7 in the transporting direction A. In other words, the dew-condensation inducing portion 15 is in contact with the medium support portion 6. Accordingly, when the dew-condensation inducing portion 15 is deformed, there is a concern that the medium support portion 6 may also be deformed. The reason for this is as follows. When the medium support portion 6 is deformed, there is a possibility that the factor by the dew-condensation inducing portion 15 may be added to the factor by the medium support portion 6 itself.

However, in the recording apparatus 1 of this embodiment, the dew-condensation inducing portion 15 is connected to the reinforcing member 20 of which the thermal expansion coefficient is smaller than that of the dew-condensation inducing portion 15. Accordingly, deformation of the dew-condensation inducing portion 15 due to, for example, heat from the infrared heater 9 is prevented, and thus the medium support portion 6 in contact with the dew-condensation inducing portion 15 is prevented from being deformed.

In the recording apparatus 1 of this embodiment, the medium support portion 6 and the reinforcing member 20 are connected through the springs 19, as described above. Accordingly, the medium support portion 6 is connected to the reinforcing member 20 of which the thermal expansion coefficient is smaller than that of the dew-condensation inducing portion 15, in such a manner that the medium support portion 6 is prevented from being deformed. Furthermore, the springs 19 are connected to the reinforcing member 20, in such a manner that tension is applied to the medium support portion 6. The medium support portion 6 is stretched by applying tension to the medium support portion 6. As a result, it is possible to effectively prevent deformation of the medium support portion 6.

In the recording apparatus 1 of this embodiment, the reinforcing member 20 is fastened to the dew-condensation inducing portion 15. This will be described below in detail. Accordingly, the dew-condensation inducing portion 15 is firmly connected to the reinforcing member 20 of which the thermal expansion coefficient is smaller than that of the dew-condensation inducing portion 15. Therefore, the dew-condensation inducing portion 15 is effectively prevented from being deformed, and thus the medium support portion 6 in contact with the dew-condensation inducing portion 15 is prevented from being deformed.

In the recording apparatus 1 of this embodiment, the dew-condensation inducing portion 15 includes the first dew-condensation inducing portion 7 and the second dew-condensation inducing portion 8. In this case, the opening portions 23 for allowing the steam to pass therethrough are provided in the first dew-condensation inducing portion 7, as illustrated in FIGS. 3 and 5. The second dew-condensation inducing portion 8 can condense the steam passing through the opening portions 23. Accordingly, in the recording apparatus 1 of this embodiment, the steam is removed, through the opening portions 23, from the vicinity of the first dew-condensation inducing portion 7 and, further, both the first dew-condensation inducing portion 7 and the second dew-condensation inducing portion 8 condense the steam, in such a manner that the concentration of the steam is reduced. As a result, the steam can be effectively prevented from condensing in the medium support portion 6.

Next, the details of the tension applying mechanism 24 of the recording apparatus 1 of this embodiment will be described.

Figure 6:
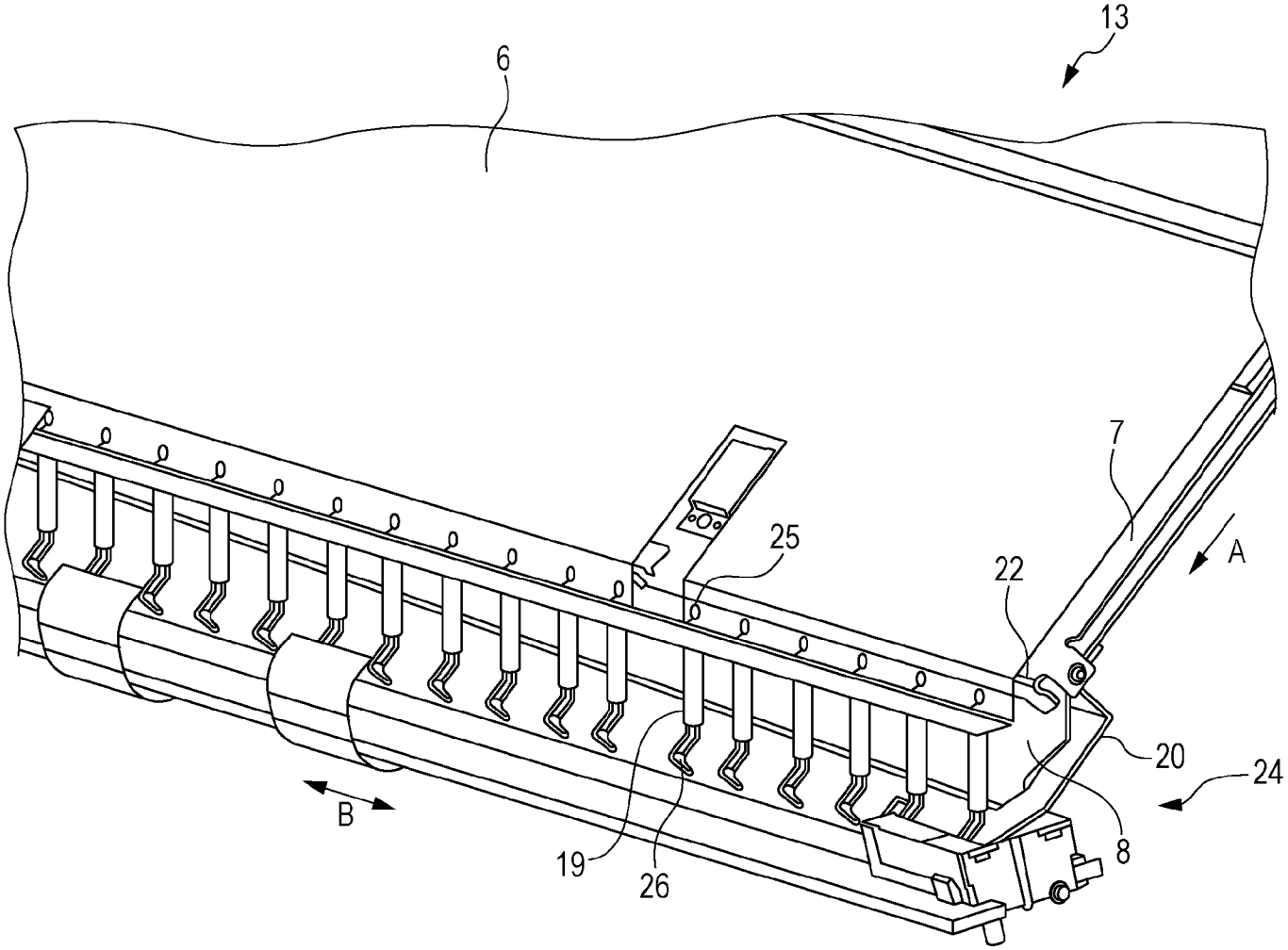
FIG. 6 is a schematic perspective view illustrating the medium support mechanism in the recording apparatus of the embodiment of the invention.
Figure 7:
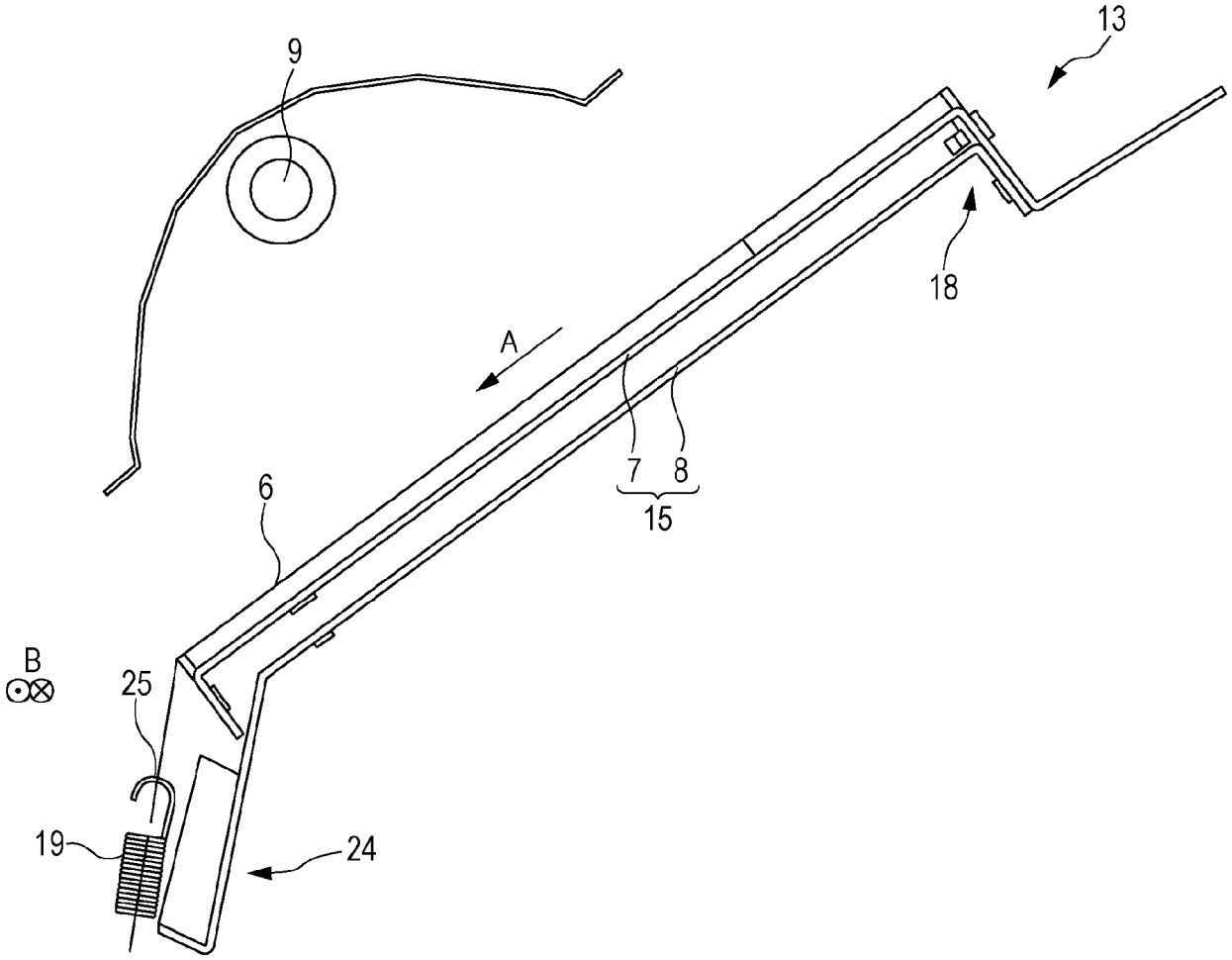
FIG. 7 is a schematic lateral cross-sectional view illustrating the medium support mechanism in the recording apparatus of the embodiment of the invention.
Figure 8:
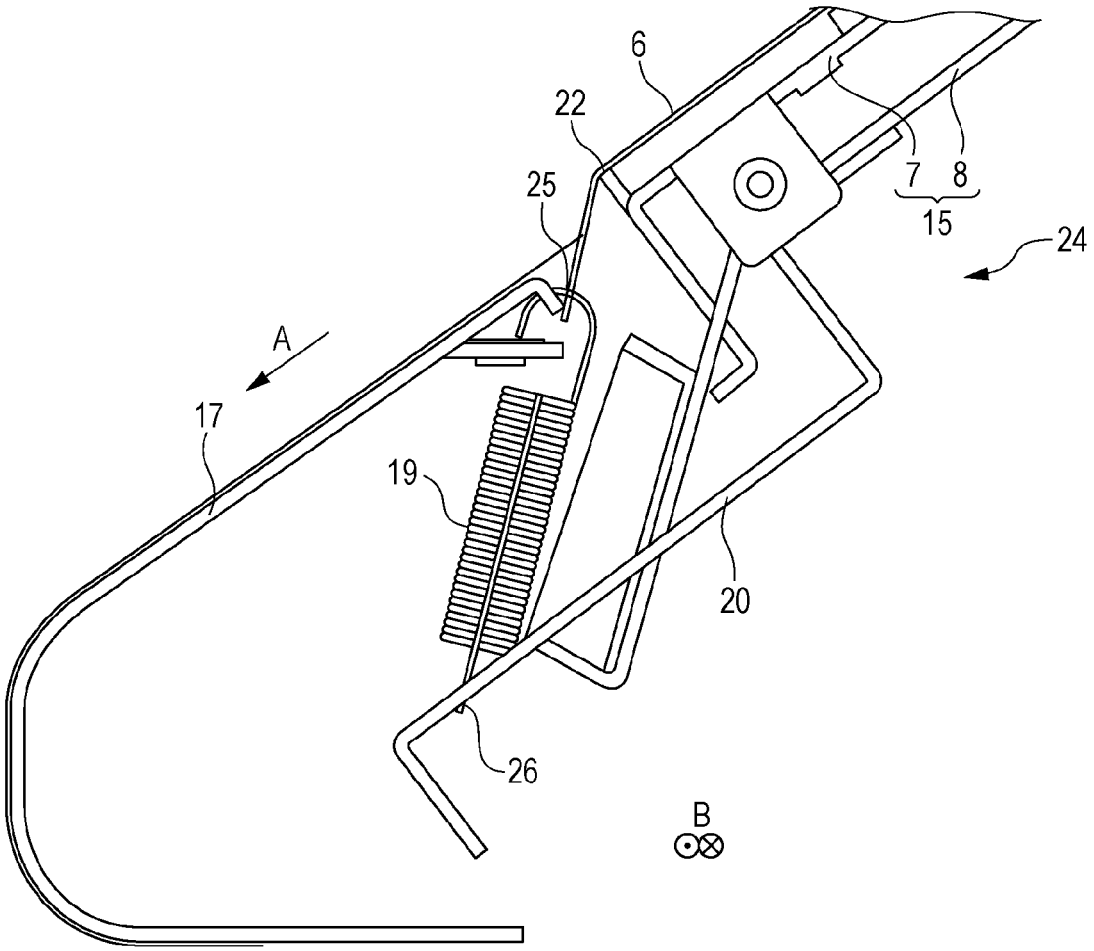
FIG. 8 is a schematic lateral cross-sectional view illustrating a tension applying mechanism in the recording apparatus of the embodiment of the invention.

FIG. 6 is a schematic perspective view illustrating the medium support mechanism 13 of the recording apparatus 1 of this embodiment. FIG. 7 is a schematic lateral cross-sectional view illustrating the medium support mechanism 13 of the recording apparatus 1 of this embodiment, in which the reinforcing member 20 is not illustrated. FIG. 8 is a schematic lateral cross-sectional view illustrating the tension applying mechanism 24 of the recording apparatus 1 of this embodiment.

A plurality of hole portions 25 are arranged, in the intersecting direction B, in the end portion of the medium support portion 6 in the transporting direction A, as illustrated in FIG. 6. Furthermore, a plurality of hole portions 26 are arranged in the reinforcing member 20, at positions corresponding to the hole portions 25. The springs 19 are hooked to both the hole portions 25 and the hole portions 26, in such a manner that the springs 19 connect the medium support portion 6 and the reinforcing member 20, as illustrated in FIGS. 6 to 8. Accordingly, the springs 19 cause the medium support portion 6 to be in contact with the ridge of the end portion 22 of the first dew-condensation inducing portion 7, in which the end portion 22 is located on the downstream side of the first dew-condensation inducing portion 7 in the transporting direction A. In other words, the medium support portion 6 is stretched in the transporting direction A, by a plurality of springs 19 hooked to the reinforcing member 20, in such a manner that the medium support portion 6 receives tension from the plurality of springs 19. As a result, the medium support portion 6 extends in the area facing the infrared heater 9.

As described above, in the recording apparatus 1 of this embodiment, the medium support portion 6, the first dew-condensation inducing portion 7, and the second dew-condensation inducing portion 8 are not fastened to one another, on the downstream side thereof in the transporting direction A. Accordingly, it is easy for the downstream side of the medium support portion 6 in the transporting direction A to become a high temperature, and thus it is easy for the medium support portion 6 to be thermally expanded. Therefore, the medium support portion 6 receives, on the downstream side thereof in the transporting direction A, tension from the plurality of springs 19, in such a manner that the medium support portion 6 is effectively prevented from being deformed.

Next, the details of the fastening portion of the reinforcing member 20, relating to the dew-condensation inducing portion 15, will be described.

Figure 9:
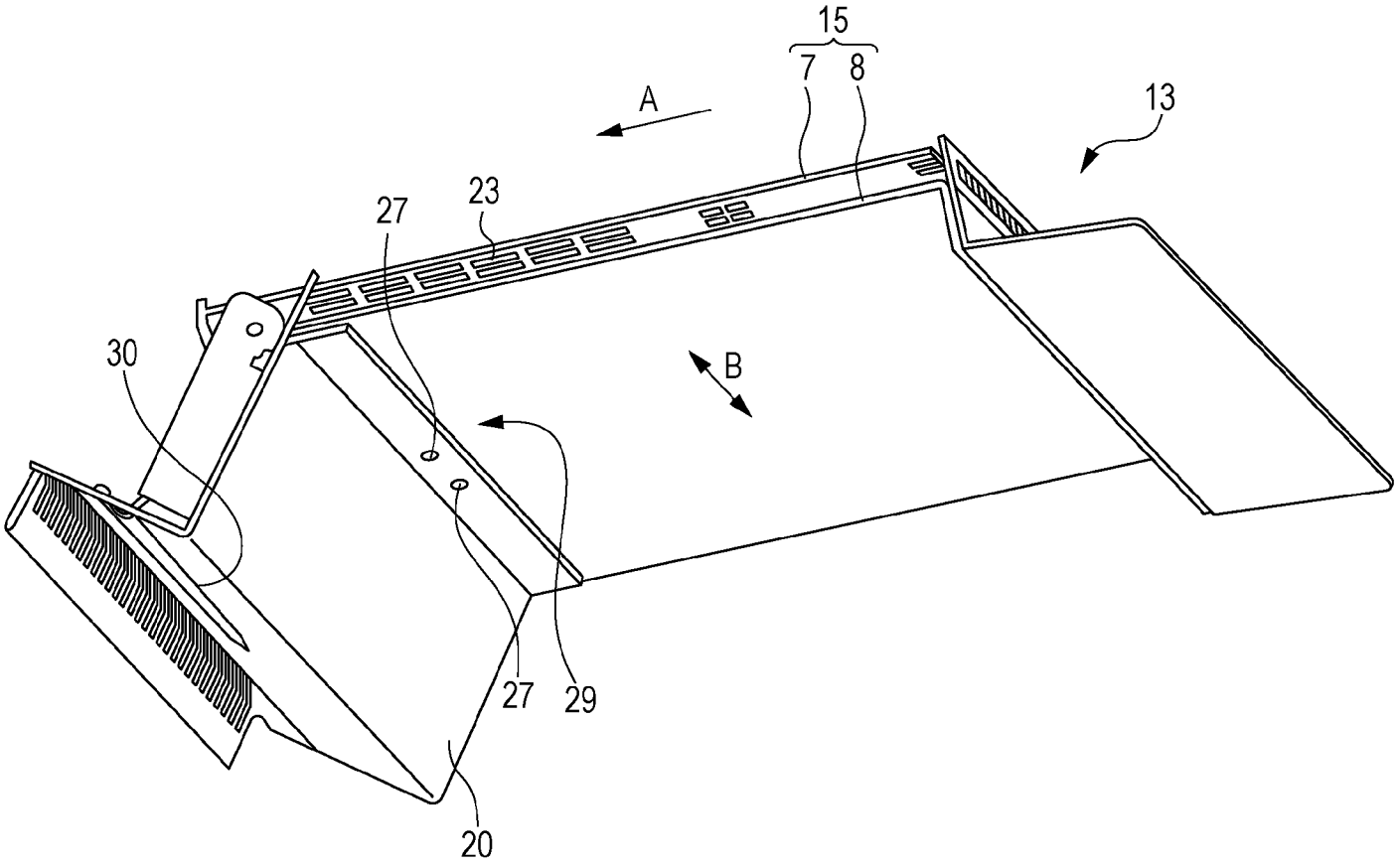
FIG. 9 is a schematic perspective view of the medium support mechanism in the recording apparatus of the embodiment of the invention, when viewed from the dew-condensation inducing portion side.
Figure 10:
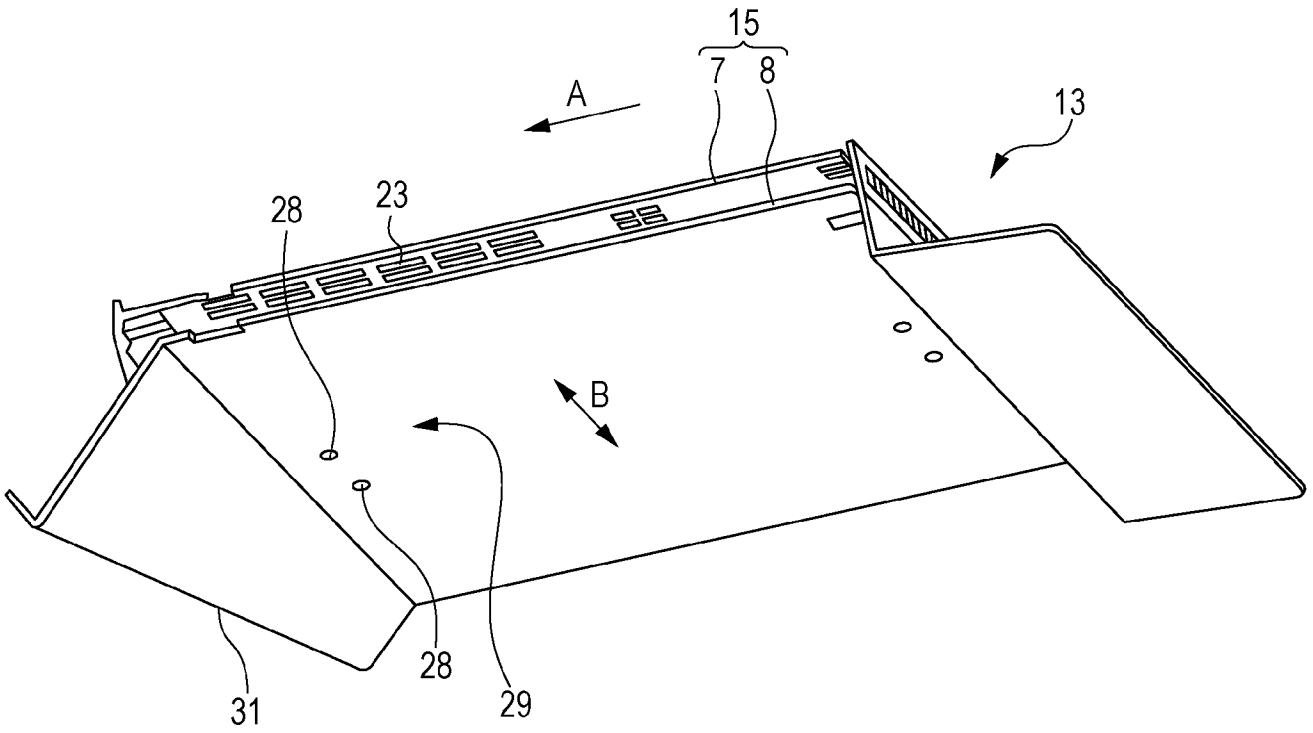
FIG. 10 is a schematic perspective view of the medium support mechanism in the recording apparatus of the embodiment of the invention, when viewed from the dew-condensation inducing portion side.

FIGS. 9 and 10 are schematic perspective views of the medium support mechanism 13 in the recording apparatus 1 of this embodiment, when viewed from (obliquely above) the dew-condensation inducing portion 15 side. In the illustrations of FIGS. 9 and 10, the medium support portion 6 is removed. The illustration of FIG. 9 shows a state where the reinforcing member 20 is fastened to the dew-condensation inducing portion 15. The illustration of FIG. 10 shows a state where the reinforcing member 20 is removed from the dew-condensation inducing portion 15.

Figure 11:
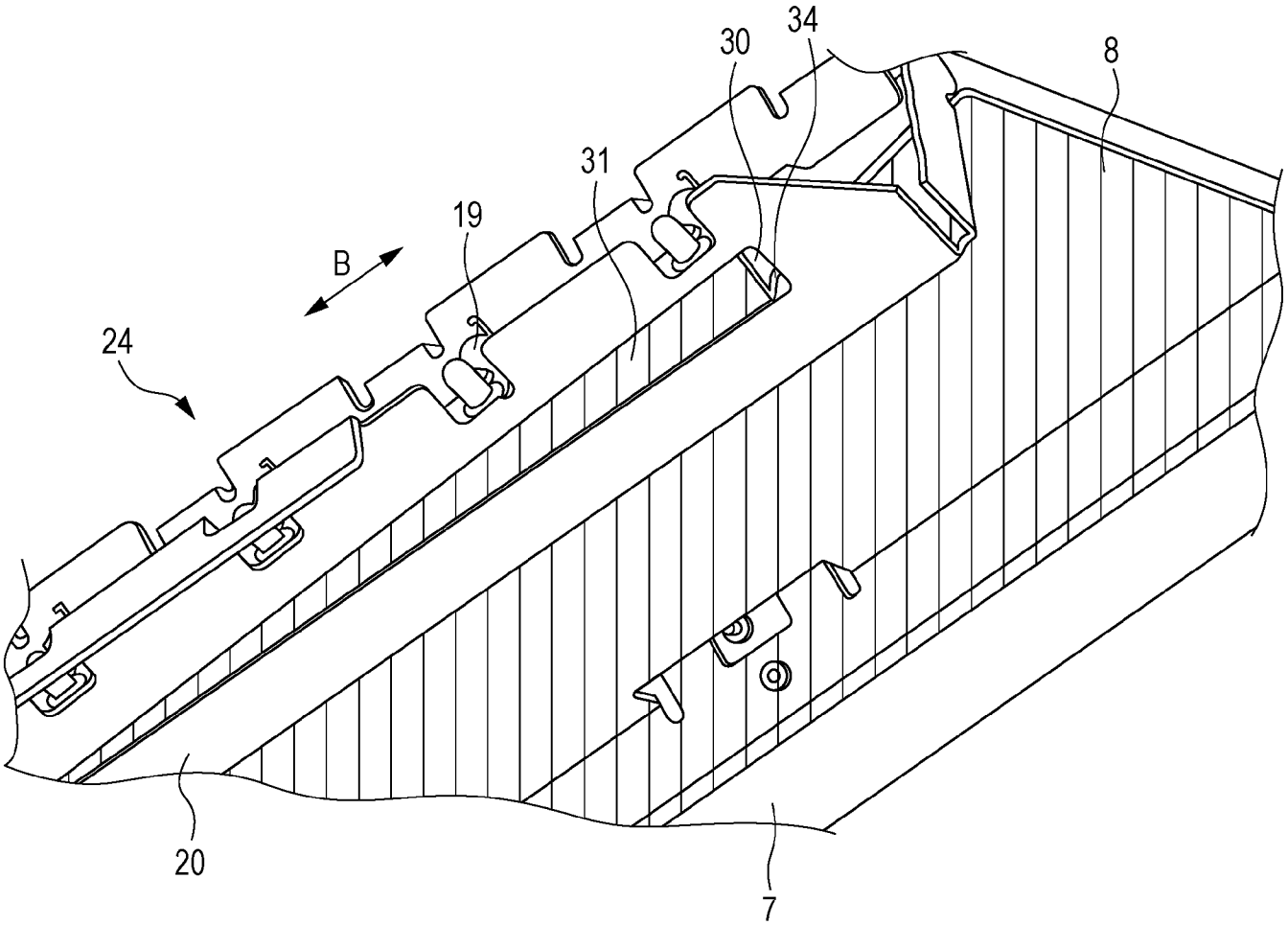
FIG. 11 is a schematic perspective view of the tension applying mechanism in the recording apparatus of the embodiment of the invention, when viewed from the dew-condensation inducing portion side.

FIG. 11 is a schematic perspective view of the tension applying mechanism 24 in the recording apparatus 1 of this embodiment, when viewed from the dew-condensation inducing portion 15 side. In the illustration of FIG. 11, the medium support portion 6 is removed.

Figure 12:
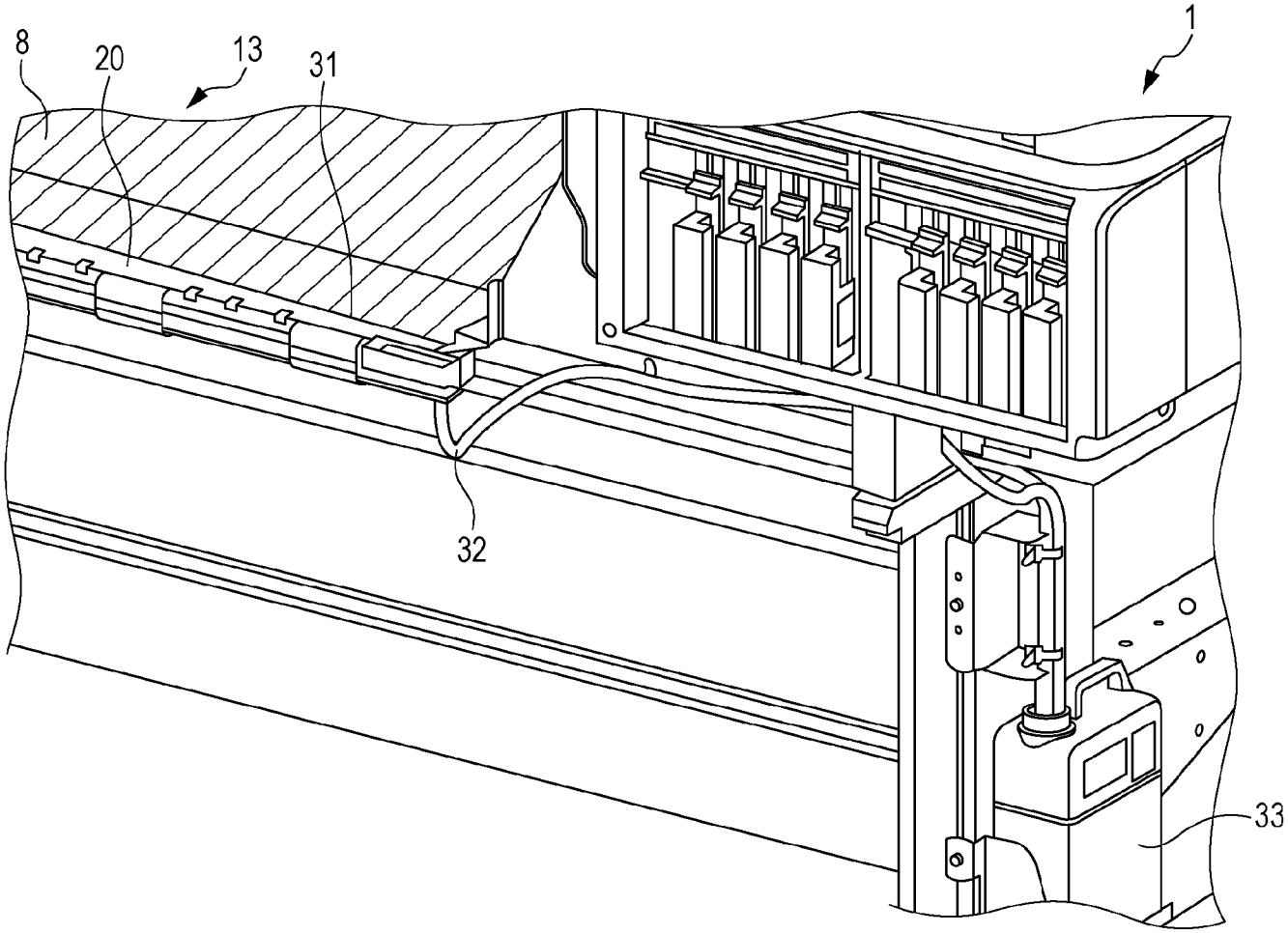
FIG. 12 is a schematic perspective view illustrating a recovery path of liquid as a result of condensing of steam, in the recording apparatus of the embodiment of the invention.

FIG. 12 is a schematic perspective view illustrating a recovery path of liquid as a result of condensing of steam, in the recording apparatus 1 of this embodiment. In the illustration of FIG. 12, both the medium support portion 6 and the first dew-condensation inducing portion 7 are removed.

In the recording apparatus 1 of this embodiment, a screw 27 is fit into a screw hole 28 of the second dew-condensation inducing portion 8, in a central portion 29 of the second dew-condensation inducing portion 8 in the intersecting direction B, in such a manner that the reinforcing member 20 is fastened to the second dew-condensation inducing portion 8, as illustrated in FIGS. 9 and 10. In other words, in the recording apparatus 1 of this embodiment, the reinforcing member 20 as a low thermal expansion portion is fastened to the central portion of the dew-condensation inducing portion 15.

Accordingly, even when the dew-condensation inducing portion 15 is thermally expanded greatly, relating to the reinforcing member 20, the dew-condensation inducing portion 15 can move in the intersecting direction B, relating to the reinforcing member 20, with the central portion 29 as a base point. Thus, both the reinforcing member 20 and the dew-condensation inducing portion 15 are prevented from being deformed and the movement amount of the dew-condensation inducing portion 15 is set to be small, with respect to the reinforcing member 20.

The central portion 29 may be located, in the strict sense, at a central position or may be located at a position somewhat away from the central position. The central portion may not be located, in terms of all directions, at the central position, but be located, in terms of one direction (which is the intersecting direction B, in this embodiment), at the central position, as in the case of this embodiment.

A bent portion 31 having a gutter shape is provided in the second dew-condensation inducing portion 8 of this embodiment, as illustrated in FIGS. 10 and 11. The bent portion 31 protrudes downward and extends in the intersecting direction B. The bent portion 31 can be inserted into the reinforcing member 20 of this embodiment and a hole portion 30 is formed in the reinforcing member 20, as illustrated in FIGS. 9 and 11. The width of the hole portion 30 gradually increases, as the hole portion 30 extends from one side to the other side in the intersecting direction B. The vertical position of the bent portion 31 gradually lowers, as the bent portion 31 extends from one side to the other side in the intersecting direction B, as illustrated in FIG. 12.

In the recording apparatus 1 of this embodiment, the vertical position of the bent portion 31 gradually lowers, as the bent portion 31 extends from one side to the other side in the intersecting direction B, as illustrated in FIG. 12. As a result, liquid in the second dew-condensation inducing portion 8, which is as a result of condensing of steam, moves, in the intersecting direction B, in the bent portion 31 and is recovered by a waste-liquid receiving bottle 33 through a tube 32.

In the recording apparatus 1 of this embodiment, the bent portion 31 is inserted into the hole portion 30. Furthermore, the hole portion 30 has a configuration in which a gap 34 is provided, in the intersecting direction B, in the end portion between the hole portion 30 and the bent portion 31, as illustrated in FIG. 11. Accordingly, even when the second dew-condensation inducing portion 8 is thermally expanded greatly, relating to the reinforcing member 20, the second dew-condensation inducing portion 8 can move in the intersecting direction B, with respect to the reinforcing member 20. As a result, both the second dew-condensation inducing portion 8 and the reinforcing member 20 can be prevented from being deformed.

The entire disclosure of Japanese Patent Application No. 2014-015913, filed Jan. 30, 2014 is expressly incorporated reference herein.

REFERENCE SIGNS LIST

1 Recording apparatus (liquid discharging apparatus)
2 Setting portion
3 Platen
4 Recording head (liquid discharging portion)
5 Infrared heater
6 Medium support portion
7 First dew-condensation inducing portion
8 Second dew-condensation inducing portion
9 Infrared heater (drying device)
10 Winding portion
11 Transport mechanism
12 Recording mechanism
13 Medium support mechanism
14 Dry mechanism
15 Dew-condensation inducing portion
16 Fixing member
17 Fixing member
18 Fastening portion
19 Spring (tension applying portion, elastic member)
20 Reinforcing member (member less likely to be deformed than medium support portion, low thermal expansion portion)

21 Opening portion
22 Downstream-side end portion of first dew-condensation inducing portion 7 in transporting direction A
23 Opening portion
24 Tension applying mechanism
25 Hole portion
26 Hole portion
27 Screw
28 Screw hole
29 Central portion of second dew-condensation inducing portion 8 in intersecting direction B
30 Hole portion
31 Bent portion
32 Tube
33 Waste-liquid receiving bottle
34 Gap
P Recording medium
R1 Roll of recording medium
R2 Roll of recording medium

The invention claimed is:

1. A liquid discharging apparatus comprising:

a medium support portion which supports a recording medium, the medium support portion including a first portion which supports the recording medium, a second portion that is beneath the first portion, and a third portion that is beneath the second portion, wherein the first, second, and third portions are connected at a first end; and a tension applying portion which applies tension to a second end of the first portion of the medium support portion.

2. The liquid discharging apparatus according to claim 1, wherein the tension applying portion includes an elastic member.

3. The liquid discharging apparatus according to claim 2, wherein the elastic member is connected to the first portion of the medium support portion and a member less likely to be deformed than the medium support portion.

4. The liquid discharging apparatus according to claim 1, further comprising:

a liquid discharging portion which discharges liquid onto the recording medium; and a drying device which heats and dries the liquid, wherein, when the drying device dries the liquid, the first portion of the medium support portion supports the recording medium.

5. The liquid discharging apparatus according to claim 4, wherein the first portion of the medium support portion has an opening portion which allows steam generated at the time of drying the liquid using the drying device to pass therethrough.

6. The liquid discharging apparatus according to claim 5, further comprising:

a dew-condensation inducing portion which condenses the steam passing through the opening portion, the dew-condensation inducing portion including the second and third portions of the medium support portion.

7. The liquid discharging apparatus according to claim 5 wherein the first portion of the medium support portion has a mesh member.

* * * * *